United States Patent [19]

Meyer et al.

[11] 4,269,265

[45] May 26, 1981

[54] TUBULAR HEAT EXCHANGER WITH TURBULATOR

[75] Inventors: Robert A. Meyer; Richard A. Bretl, both of Racine, Wis.

[73] Assignee: Modine Manufacturing Company, Racine, Wis.

[21] Appl. No.: 98,707

[22] Filed: Nov. 29, 1979

[51] Int. Cl.[3] ..... F28F 13/12

[52] U.S. Cl. ..... 165/109 T; 138/38

[58] Field of Search ..... 138/38, 42, 172; 165/177, 109 T, 109 R

[56] References Cited

U.S. PATENT DOCUMENTS

| | | | |
|---|---|---|---|
| 2,300,579 | 11/1942 | Lenning | 138/38 |
| 2,500,501 | 3/1950 | Trumpler | 138/38 |
| 3,595,299 | 7/1971 | Weishaupt et al. | 138/38 |

FOREIGN PATENT DOCUMENTS

| | | | |
|---|---|---|---|
| 354034 | 9/1905 | France | 165/177 |
| 2043 | of 1859 | United Kingdom | 165/156 |
| 417668 | 10/1934 | United Kingdom | 138/38 |
| 538018 | 7/1941 | United Kingdom | 138/38 |
| 695253 | 8/1953 | United Kingdom | 165/177 |
| 1146162 | 3/1969 | United Kingdom | 165/177 |

*Primary Examiner*—Sheldon J. Richter

*Attorney, Agent, or Firm*—Wegner, Stellman, McCord, Wiles & Wood

[57] ABSTRACT

A tubular heat exchanger for liquids having a turbulator in a liquid flow tube offering low resistance to internal liquid flow. The liquid flow tube has an inside surface and transverse minor and major inner dimensions. The internal turbulator is elongated and comprises a heat conducting wire having successive, substantially canted undulations in contact with the tube's inner surface.

3 Claims, 2 Drawing Figures

TUBULAR HEAT EXCHANGER WITH TURBULATOR

BACKGROUND OF THE INVENTION

The tubular heat exchanger of this invention is particularly suited for cooling oil such as lubricating oil for an internal combustion engine with the heat exchanger conveying the oil in contact with a surrounding coolant such as water. Heat exchangers of this type are the subject of U.S. Pat. Nos. 3,456,320 and 3,734,135, both assigned to the assignee hereof.

DESCRIPTION OF THE PREFERRED EMBODIMENT

Figure 1:
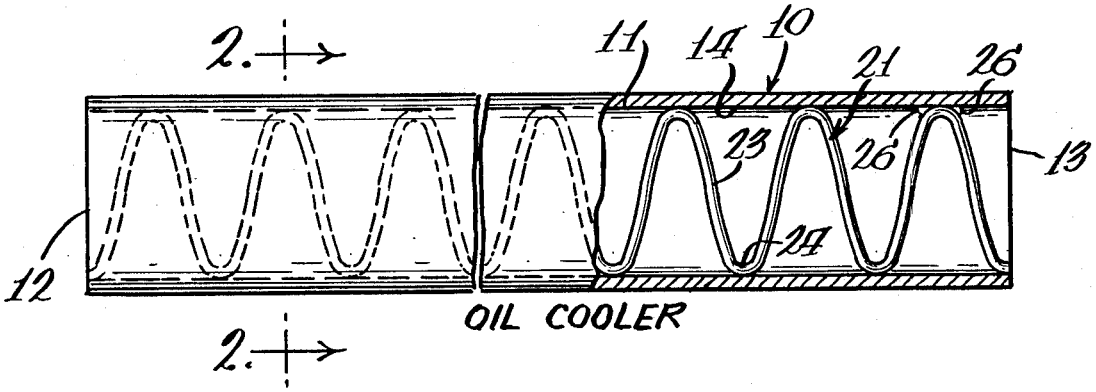
FIG. 1 is a fragmentary side elevational view partially in section of a tubular heat exchanger embodying the invention.

In the illustrated embodiment the heat exchanger 10 is embodied in an elongated tube 11 having open opposite ends 12 and 13. The tube 11 has an inside surface 14 and transverse minor and major inner dimensions which are the distance between the side walls 15 and 16 and the end walls 17 and 18, respectively.

The tube 11 of the heat exchanger 10 contains an elongated internal turbulator 21 comprising a heat conducting wire 22 formed with successive undulations 23 each having a peak 24 defining an arcuate area of the wire 22. This wire may be of aluminum, copper, steel or any solid heat conducting metal.

Figure 2:
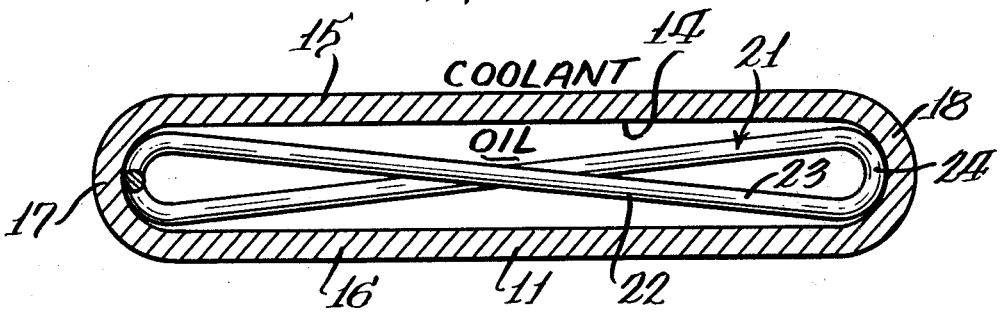
FIG. 2 is a transverse sectional view taken substantially along line 2—2 of FIG. 1.

As can be seen in FIG. 2, each wire turbulator 21 substantially spans the interior of the tube at least in the transverse major direction or cross section of length and preferably, as shown, both the major and minor dimensions which are the width and the height as viewed in FIG. 2.

The peaks 24 of the turbulator define arcuate areas as shown in FIG. 2 which are in contact with the interior surfaces 14 of the tube 11. For better heat transfer and turbulence without providing substantial resistance to internal liquid flow the turbulator is canted at an angle to the internal dimensions.

In a preferred construction the wire is resilient and the inner dimensions of the tube are less than the corresponding dimensions of the wire turbulator with the result that the turbulator is held in position in the tube 11 by the springy pressure of the wire against the tube's inner surfaces 14.

If desired, the wire may be coated with a heat activated coating substance such as an aluminum brazing alloy or solder where the parts are aluminum or solder or copper where the parts are steel. The melting point of the coating material is lower than that of the metal parts so that upon heating of the unit the coating melts and upon cooling bonds the turbulator to the inner surface 14 as indicated at 26 in FIG. 1. Such a use of a bonding coating material is disclosed in U.S. Pat. No. 2,912,749 for a tube and fin heat exchanger, this patent also being assigned to the assignee hereof.

The wire turbulator 21 of this invention may be dimensioned to extend the entire length of the tube 11 or may be in successive pieces with each piece canted in the same direction and successive pieces canted at an angle to the other to give the same appearance as in FIG. 2. If desired, it is also possible with this invention to have several wire turbulators as described and have them innermeshed. This would tend to create more turbulence but would also create greater pressure drop.

In the preferred construction the turbulator extends the entire length of the tube thereby providing maximum turbulation and heat transfer between a liquid such as oil in the tube and a fluid such as water on the exterior of the tube with minimum pressure drop of the liquid flowing through the tube.

The canting of the turbulator results in spanning the entire height and width of the tube to provide sufficient heat exchange turbulence while still permitting a high rate of liquid flow within the tube with a desirable minimum pressure drop of the liquid.

The undulations or wavy formation of the wire turbulator provide intermittent turbulation along the tube length. The turbulator of this invention results in maximum heat exchange performance combined with a minimum pressure drop of liquid flow through the tube. Such reduction in pressure drop is very important when the liquid being cooled is a lubricating oil or the like. This invention, therefore, provides a simple and economical balance of shape, internal dimensions and spacing of the turbulator from the tube walls to accommodate a wide range of tube sizes.

The diameter of the wire of the turbulator can be varied as desired to produce maximum performance consistent with a desired minimum pressure drop.

Having described our invention as related to the embodiment shown in the accompanying drawings, it is our intention that the invention be not limited by any of the details of description, unless otherwise specified, but rather be construed broadly within its spirit and scope as set out in the appended claims.

We claim:

1. A tubular heat exchanger for liquids with a turbulator in the tube offering low resistance to internal liquid flow, comprising: a liquid flow tube having an inside surface and transverse minor and major inner dimensions, said major inner dimension being greater than said minor inner dimension; and an elongated internal turbulator comprising a continuous length of heat conducting wire spanning the length of said tube, said wire having successive undulations in contact with said inner surface, said turbulator substantially spanning said tube in said transverse major dimension.

2. The heat exchanger of claim 1 wherein said turbulator is canted with respect to the said transverse dimensions.

3. A tubular heat exchanger for liquids with a turbulator in the tube offering low resistance to internal liquid flow, comprising: a liquid flow tube having an inside surface and transverse minor and major inner dimensions, said major inner dimension being greater than said minor inner dimension; and an elongated internal turbulator comprising successive continuous lengths of heat conducting wire that together span the length of said tube, said wire having successive undulations in contact with said inner surface, said turbulator substantially spanning said tube in said transverse major dimension.

* * * * *